United States Patent [19]

Ludvigson

[11] 4,048,706

[45] Sept. 20, 1977

[54] METHOD OF ELIMINATING AND UNEVEN STRESS DISTRIBUTION IN AN ELONGATED REINFORCED MEMBER

[76] Inventor: Birger Ludvigson, Sodra Vagen 38, Goteborg, Sweden, 41256

[21] Appl. No.: 654,988

[22] Filed: Feb. 3, 1976

[30] Foreign Application Priority Data

Feb. 4, 1975 Sweden ..... 7501229

[51] Int. Cl.[2] ..... E21B 19/00

[52] U.S. Cl. ..... 29/452; 254/29 A

[58] Field of Search ..... 29/452; 254/29 A, 29 R

[56] References Cited

U.S. PATENT DOCUMENTS

| | | | |
|---|---|---|---|
| 3,004,389 | 10/1961 | Muller | 254/29 R |
| 3,176,961 | 4/1965 | Glass | 254/29 A |

*Primary Examiner*—Robert C. Watson

*Attorney, Agent, or Firm*—McGlynn and Milton

[57] ABSTRACT

Reinforcing members of concrete structures are often tensioned against a considerable frictional resistance, which causes an uneven stress distribution along the member. This means that the reinforcing capacity of the member is unsatisfactorily utilized. To obtain a more even stress distribution the tensioning operation is terminated by a sudden, measured release of tensioning force, resulting in a shock wave progressing along the member.

13 Claims, 4 Drawing Figures

METHOD OF ELIMINATING AND UNEVEN STRESS DISTRIBUTION IN AN ELONGATED REINFORCED MEMBER

BACKGROUND OF THE INVENTION

The present invention refers to a method and means for tensioning a reinforcing member, which may be a wire, a group of parallel wires or a bar along which frictional forces occur. According to methods now used the reinforcing members are tensioned by means of a statically (slowly) working ram, being applied to one end of the member, the other end thereof being fixed. Alternatively pulling forces may be applied to both ends of the member. On both occasions the resulting tension will decrease due to friction, in a direction away from the point where the tensioning force is applied. As the influence of the reinforcement in a certain section is proportional to the tensional force in the same section, a reduced tension due to fricton will mean that the reinforcement is unsatisfactorily utilized.

The aim of the present invention is to better use the strengthening bars by a method and means which eliminate the influence of friction, and provide a more constant tension in the reinforcing members, or a tension, which better corrsesponds to specific demands.

SUMMARY OF THE INVENTION

The method according to the invention is characterized in that the tensioning, or at least part thereof, is brought about by a dynamic application, or a release of, a tensioning force. Hereby a progressive tensioning wave is brought about in the reinforcing member, the energy of said wave being continuously consumed by friction losses, and a static tensioning condition remains.

If one end of the reinforcing member is fixed, and its opposite end is subjected to the load, the frictonal force, F, i.e. the loss in tensioning force, may be calculated according to known formulas.

Method No. 1. If the magnitude of the frictional forces, F, is known, a constant final tension along the member is obtainable, if the tensioning is brought about by a momentarily applied tensioning force, K, the magnitude of which is a multiple of the frictional force: i.e. $K = n \times F$, where $n$ is an integer.

Method No. 2. A tensioning according to the following program will lead to a constant final tension.

1. Static (slow) tensioning until the desired force K is attained at the movable end of the member.

2. The application of a momentarily applied, additional force F/2 until the elongation is increased by $(\delta' - \delta'')$.

In above expression $\delta' = (KL/EA)$ : i.e. an elongation of the member due to force K without any frictional resistance.

$\delta''$ = The actual elongation of the member caused by force K, but reduced due to friction.

$\delta''$ may be measured after the static tensioning according to step 1.

E, A and L are the modulus of elasticity, the cross sectional area and the length, respectively, of the reinforcing member.

The methods according to the invention presuppose the use of a dynamically acting ram, by means of which a force of a predetermined magnitude may be momentarily applied. According to method No 1 the magnitude of the force shall be maintained when the tensioning wave has passed away and provided a constant force along the member. The movable end thereof is thereafter locked. According to method No 2 the force shall be maintained until a predetermined elongation has been obtained, whereupon the end of the member is locked.

DESCRIPTION OF SOME PREFERRED EMBODIMENTS

Figure 1:
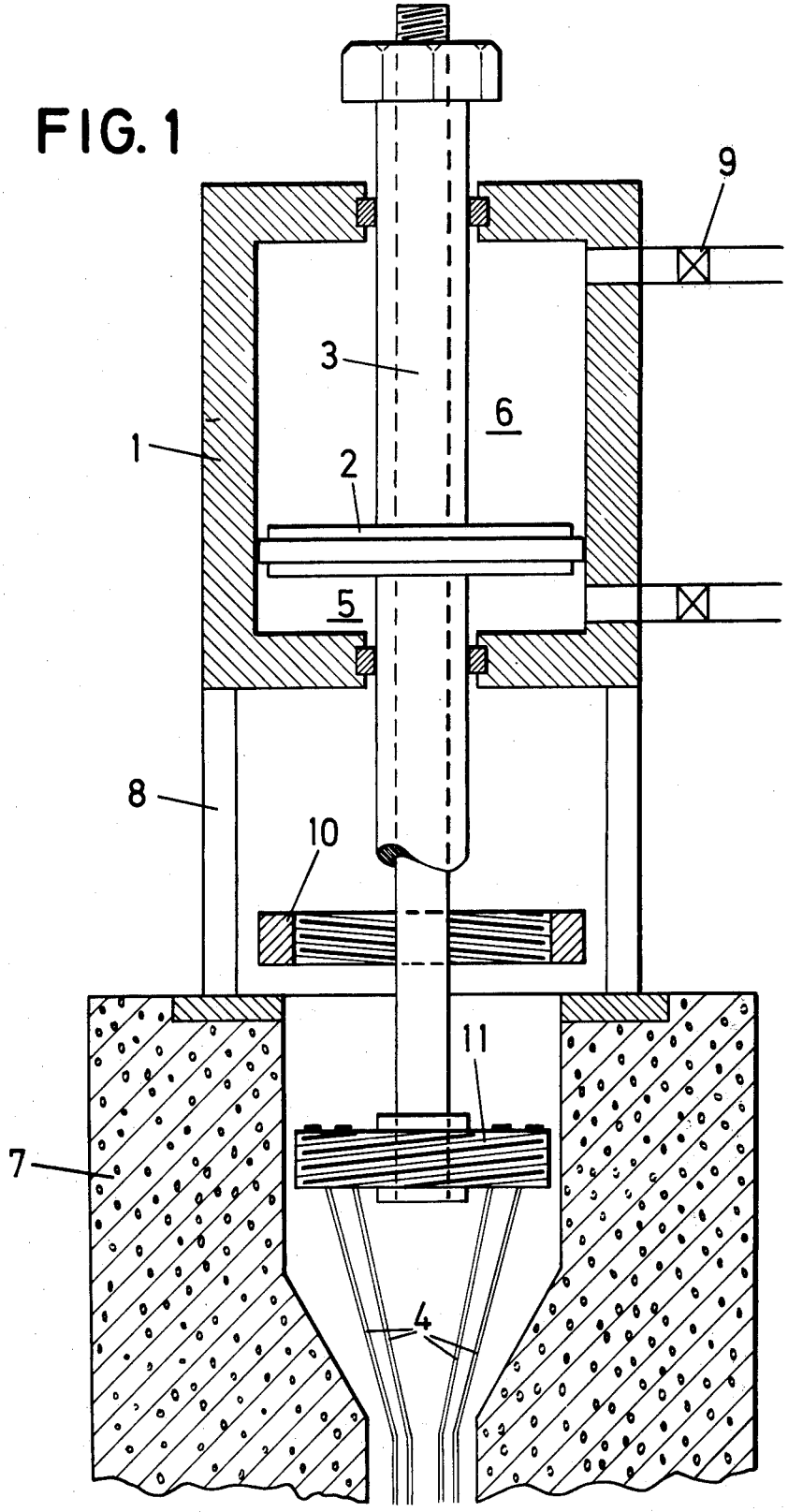
FIG. 1 is a schematic view of a ram suitable for working the invention.

In FIG. 1 a piston 2 operates in a cylinder 1. A piston rod 3 connected to piston 2 extends through at least one of the covers of cylinder 1, said rod being connectable to a reinforcing member 4, which is to be tensioned. Piston 2 subdivides cylinder 1 into two chambers 5 and 6, respectively. Before the tensioning operation according to the invention is to be performed a previously applied tensioning force applied to the free end of the tensioning member is balanced by means of a volume of pressure fluid introduced into chamber 5. The reaction force is transferred to the concrete body 7 by a support 8. The pressure in chamber 5 is increased until it corresponds to the tensioning force desired. The condition $k = n \times F$ should be taken into consideration. Piston 2 is maintained in position, for instance by a liquid enclosed in chamber 6. Alternatively chamber 6 is supplied with gas under pressure, the pressure being successively increased to compensate the increased pressure in chamber 5.

The tensioning moment is obtained by suddenly decreasing the pressure in chamber 6, for instance by opening a valve 9. The elongation obtained should not amount to the stroke length of piston 2 within chamber 6.

A locking ring is in the drawing provided with a nut 10, which is screwed unto the anchoring plate 11, which, ater the tensioning operation, will remain outside the face of the concrete structure.

Chamber 5 is connected to a pressure tank, having means for adjusting the pressure. The volume of this tank and its connection to chamber 5 shall be sufficient to maintain the pressure within the tank substantially constant during the tensioning moment.

The pressure tank, means for governing the pressure therein and the conduit to the cylinder are not shown in the drawing.

The static tensioning of the free end of the member according to step 1 of method 2 is balanced by means of a volume of pressure fluid introduced into chamber 5.

Step 2 of the tensioning operation is started by the pressure in chamber 5 being increased by the tensioning force F/2, while the piston 2 is maintained in position in above described manner.

The additional force according to step 2 is obtained by the pressure in chamber 6 being suddenly blown off. The stroke of piston 2 is limited to $(\sigma' - \sigma'')$, for instance by restricting the amount of fluid escaping through valve 9.

Alternatively the pressure in the tank is increased while the supply conduit to chamber 5 is shut off. The additional force is obtained by the conduit being opened to permit a flow of a volume corresponding to a stroke volume of the piston equal to ($\delta' - \delta''$).

According to a further method a momentary release of force F is evoked, a linearly decreased speed being imposed upon the free end of the member.

The drawing shows a reinforcement, where the member 4 includes treads or wires which are attached to an anchoring plate 11 having external threads. When the tensioning is terminated this anchor plate is locked by means of a nut 10. The invention is, however, applicable to various forms of reinforcing members and methods for locking. Characterizing for the invention and common to all embodiments are the methods according to which at least the final tensioning is brought by means of a momentarily applied force, as well as the means providing this momentarily applicable force.

The magnitude of the frictional force F along the member, may, as mentioned above, be calculated by means of known formulus. It may, however, also be determined by measurements during the tensioning. When a force K > F is momentarily applied to the free end of an unloaded member, or to a member subjected to a constant load, the end of the member will move with a speed, $v(t)$, which may be determined by $$v(t) = v_o(1 - (F/2K)\, ct/L)$$

where $v_o$ = (Kc/EA) is the speed of a member not subjected to frictional resistance, and $c$ = the velocity of sound in the member.

At point $t$ = (2L/c) the direction of movement is suddenly changed, but the speed remains the same. The change in speed V can be measured, and the relationship $V = 2\, v_o(1 - (F/K))$ may be determined. Hereby $F = K\,(1 - v/2v_o)$ is obtained.

The frictional force may also be calculated from the elongation ($\delta' - \delta''$) defined hereabove. As a consequence $F = (2EA/L)\,(\delta' - \delta'')$ is obtained.

Beside the methods above described a constant final tensioning may be obtained by a repetition of slow and momentary tensionings.

The finally applied force shall, however, always have a value which has a definite relationship to the frictional force to be eliminated, and it shall be applied under controlled conditions. The magnitude as well as the manner of applying the force will depend upon the tension pattern along the member after the preliminary tensioning.

The methods above referred to have implied the tensioning, or release, respectively at one of the member only, but it is evident that the invention is applicable also with a member being tensioned from both ends.

An $x - t$ diagram according to Method 1, where ($x$, 0) is constant, is illustrated in the diagram below.

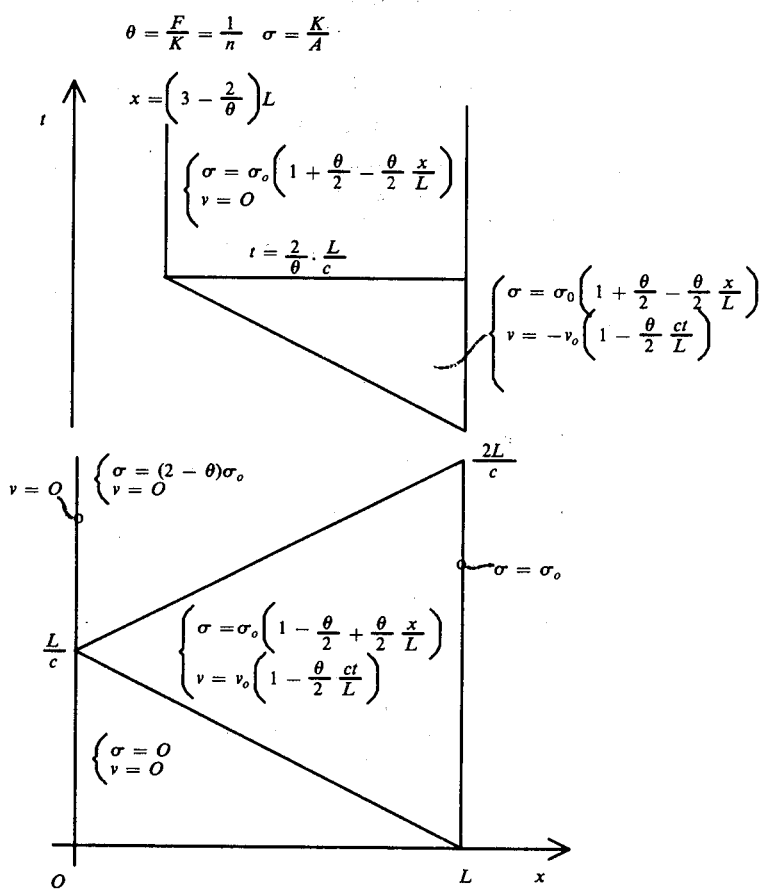

Remaining tensioning $\delta$ after a considerable time according to Method 1. It is found that $$\sigma(x, \infty) = \sigma_o \text{ when } 0 = 1, \frac{1}{2}, \frac{1}{3} \ldots \frac{1}{n}$$

-continued
$H = \theta + 1$ and $\theta = 1, 1/3, 1/5, 1/7$ and so forth
$x - t$ diagram, when $\sigma(x, 0) = \sigma_o(1 - \theta + \theta_L{}^x)$, according to Method 1.
A constant tensioning is found when
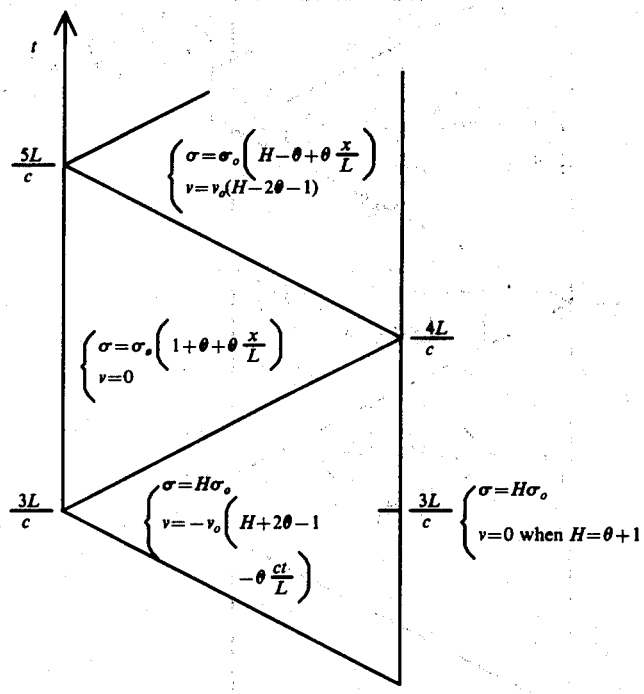
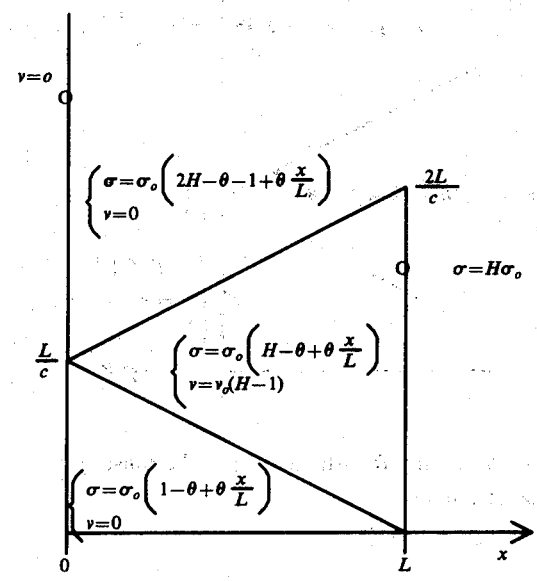
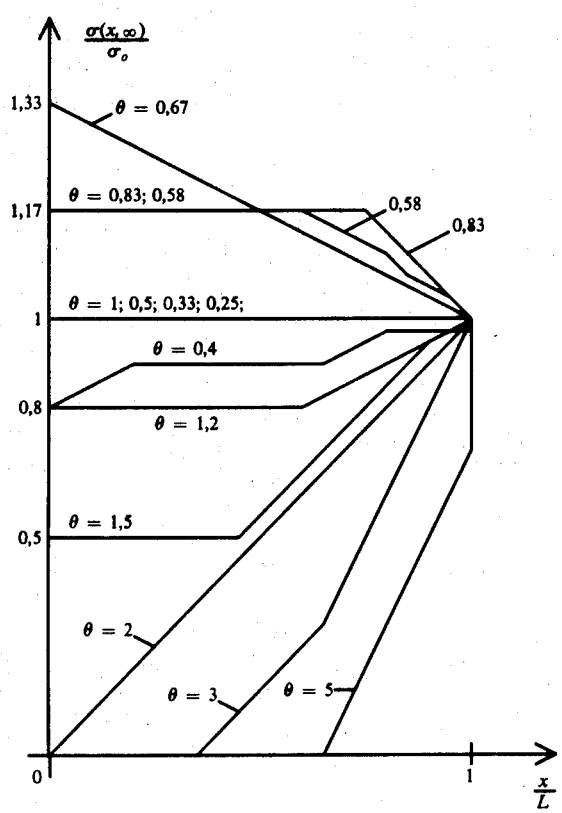

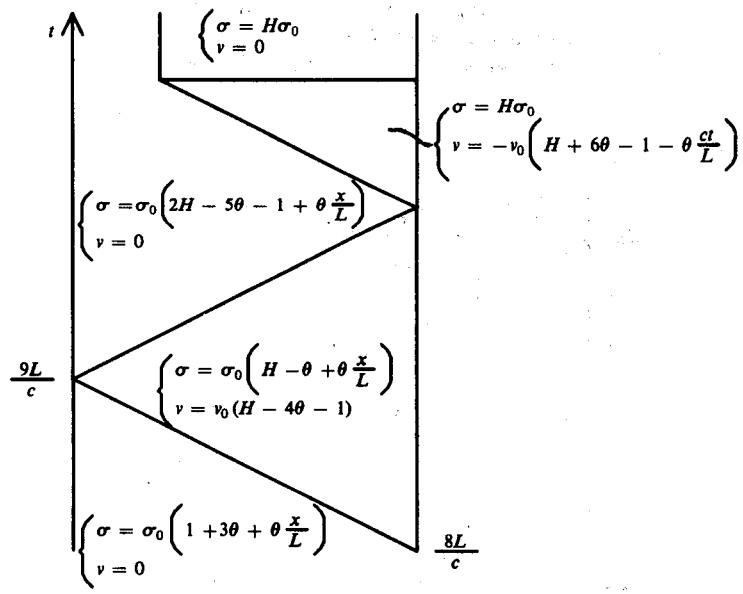
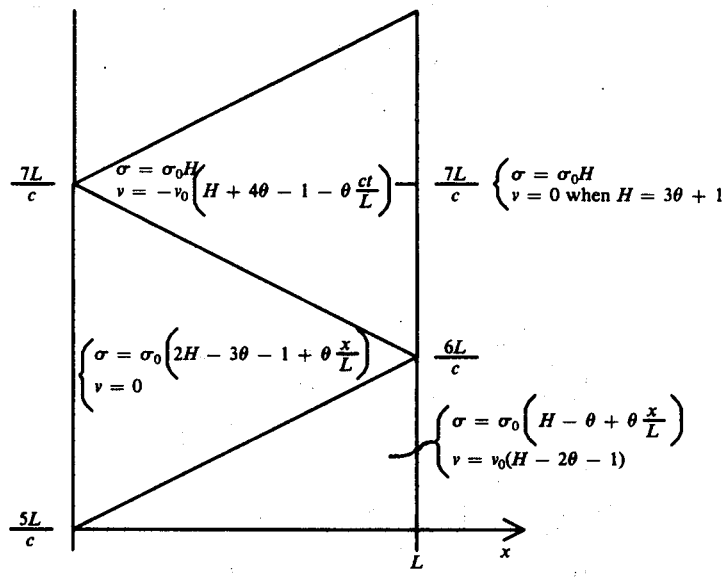
$x - t$ - relationship for Method 2 may be illustrated by the diagram below.
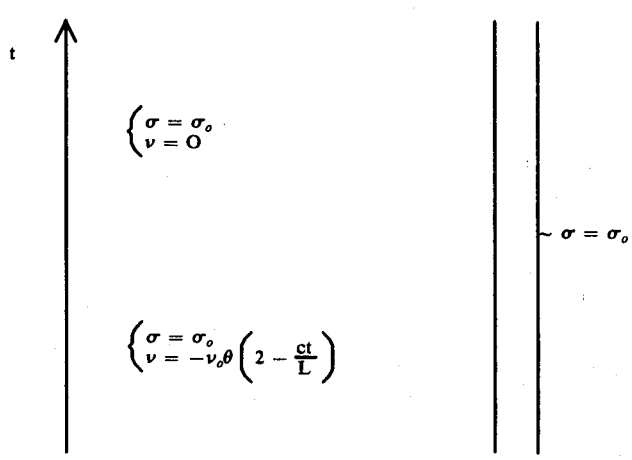

-continued

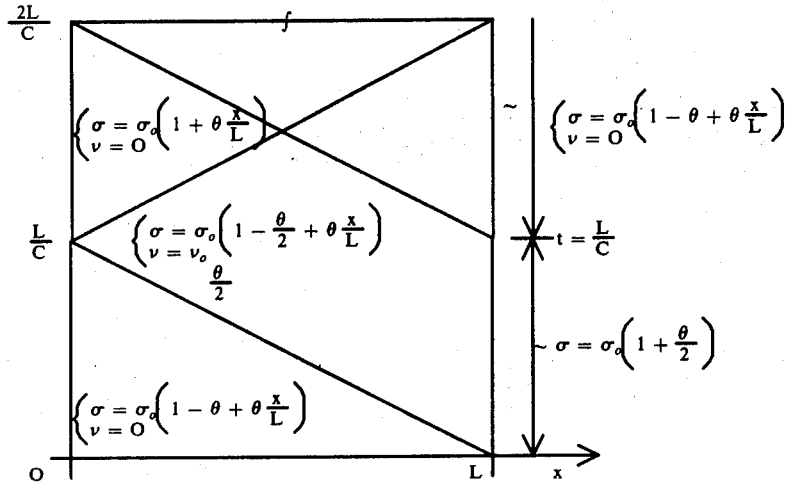

The velocity v (L, t) and the displacement δ (L, t) according to Method 2 will be illustrated by the curves below

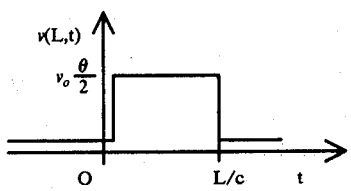

-continued

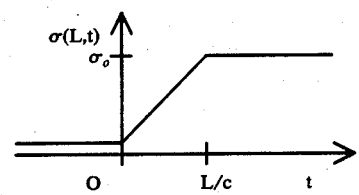

$x - t$ diagram for the case with release of tensioning during controlled velocity at the loaded end is illustrated by the diagram below.

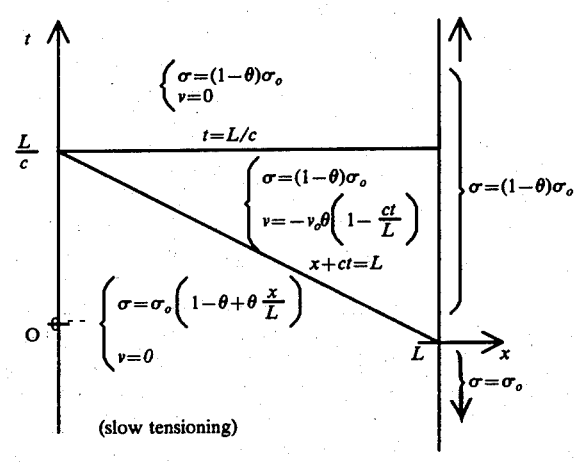

Continuation of the case according to page 13. The tension δ, the velocity v, and the displacement δ at the loaded end will be illustrated by the diagrams below.

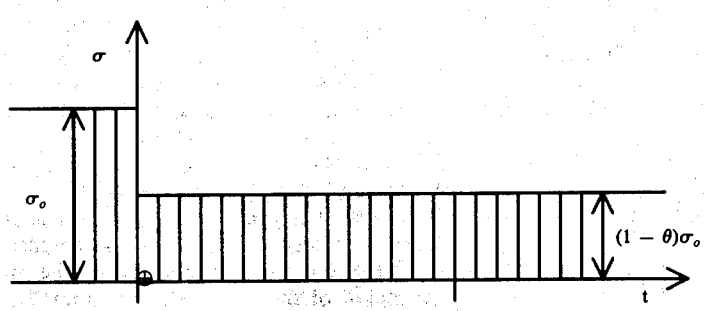

-continued

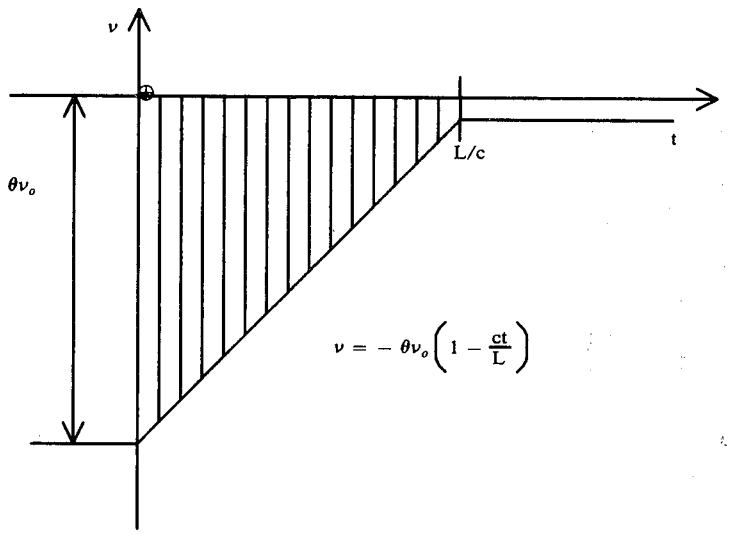

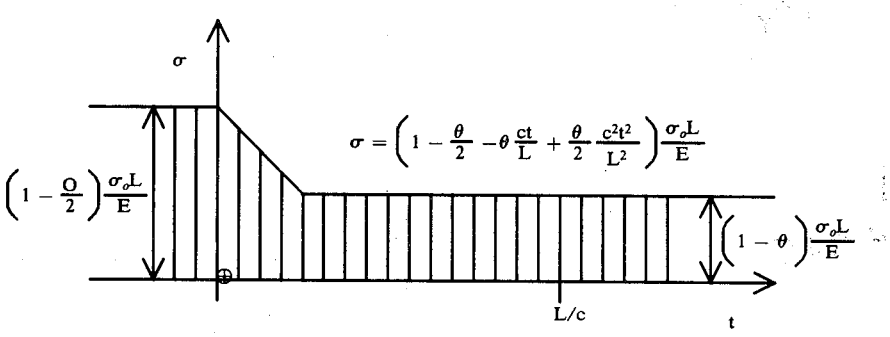

Figure 2:
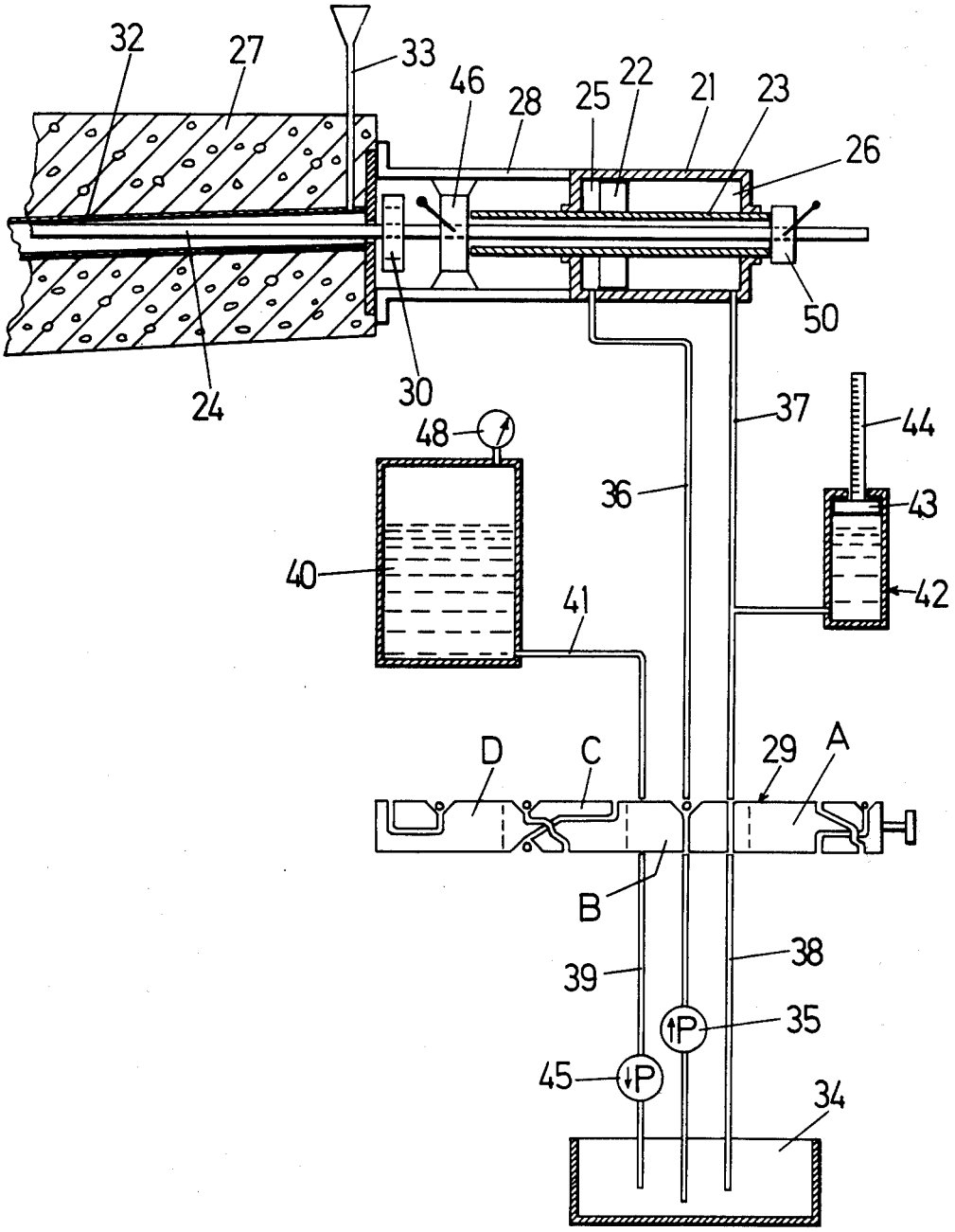
FIG. 2 shows a more detailed view of the tensioning arrangement and including a distributor valve means for obtaining one function of the valve.

FIG. 2 shows more in detail an arrangement for obtaining the desired tensioning of a reinforcing member. A ram is here shown as having a cylinder denoted by 21, a piston by 22, and a piston rod by 23. The reinforcing member is denoted by 24.

The piston divides the cylinder 21 into two chambers 25 and 26, respectively. When pressure fluid is introduced in chamber 25 the piston will move away from the concrete structure 27, and this chamber will, for short identification be termed the positive chamber, whereas the other will be termed the negative chamber.

The cylinder includes a support 28 resting against the concrete structure. A distributor valve means is denoted by 29, and means for finally locking the reinforcing member 24 in relation to the concrete structure 27 is denoted by 30.

When casting a concrete structure, one or more tubes 32 are embedded in the concrete compound in order to form passages for the reinforcing members, to be introduced and tensioned when the concrete structure has solidified. After tensioning the reinforcing member to the desired amount, the void in the tube is filled with cement slurry injected through supply means 33, and when this slurry has settled the reinforcing member is rigidly bonded to the concrete structure, all along its length, and will maintain a steady compression force thereon.

The tubes 32 will seldom, due to the form of the concrete structure, run absolutely straight, and the weight of an elongated reinforcing member will in any case tend to make the inward end of the member sag.

The is thus an apparent risk of contact between the member and the tube along part of the length of the member. This contact will result in frictional resistance when the member is being tensioned.

In FIG. 2 it is supposed that the opposite end of member 24 is fixed in relation to the concrete structure, and the sum of frictional forces will thus increase, in the direction away from the ram.

The pressure fluid system includes a source of fluid 34, a first pump 35, a conduit 36 between distributor valve means 29 and the positive chamber 25 and a further conduit 37 between said valve means and the negative chamber 26. Return flow conduits 38 and 39 lead from the valve means back to the source of fluid 34.

The system further includes a pressure fluid tank 40, in which fluid may be stored against the pressure of an enclosed volume of gas. This tank is connected to distributor valve means 29 by way of a conduit 41.

A fluid receptacle 42 is connected to conduit 37, and is formed as a cylinder in which a piston 43 is movable in response to the fluid content of the receptacle. A measuring stick 44 is connected to piston 43 to make possible an easy reading of the position of piston 43 within its cylinder. A second pump 45 is fitted in return flow conduit 39.

The intention is that ram 1, 2 shall be able to perform also the basic tensioning of reinforcing member 24; and support 28 is provided with a chuck or other clamping device 46 to permit member 24 being locked between the power strokes. A second chuck 50 is fitted to the outward end of piston rod 23.

To perform the desired functions distributor valve means 29 is provided with four sections A, B, C and D, respectively. The drawing shows the valve in position B, where pump 35 supplies pressure fluid to positive chamber 25 through conduit 36, while simultaneously fluid can flow from negative chamber 26 back to source 34 by way of conduits 37, and 38.

Repeated power strokes may be required to impart the necessary tensioning of member 24 which, between each power stroke is locked by chuck 46. When the basic tensioning is terminated piston 22 is brought to the position shown in the drawing, i.e. ready for further power stroke, and positive chamber 25 is filled (valve 29 is position B) with pressure fluid sufficient to balance the strain in the member. Chuck 46 may then be released, preferably however just before valve 29 is shifted from its C to its D position.

When in C position valve 29 permits the loading of tank 40 to a desired degree while simultaneously pump 45 withdraws a predetermined amount of fluid from receptacle 42. Valve 29 is then shifted to positon D - chuck 46 having been released - and fluid from tank 40 now rapidly flows into positive chamber 25 by way of conduits 41 and 36, causing the desired shock wave in member 24.

Fluid is simultaneously forced out of negative chamber 26 and fills receptacle 42. When this is full no further movement of piston 22 is possible as return flow through conduit 37 is blocked by valve 29 in its D-position. As mentioned before tank 40 has sufficient capacity to maintain the fluid pressure substantially constant during the shock stroke.

Figure 3:
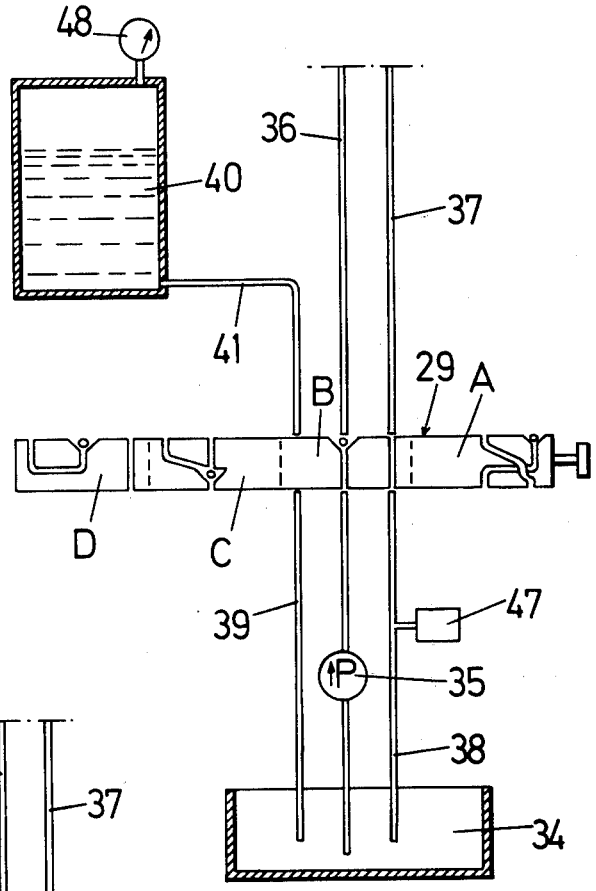
FIGS. 3 and 4 show other arrangements of distributor valve means.

The arrangement according to FIG. 3 is mainly the same as in FIG. 2, but the shock is obtained in a somewhat different manner, and distributor valve means 29A is differently shaped in its C and D sections.

The A and B sections are the same as in the previous embodiment, and it is presupposed that piston 22, before the final operation, is brought to the position shown in FIG. 2, i.e. with negative chamber 26 filled with fluid from the last return stroke.

When distributor valve means 29A is shifted to its C-position, the outflow from negative chamber 26 will be blocked, while simultaneously pump 35 loads tank 40 and positive chamber 25. Due to the resistance of the fluid in chamber 26 piston 22 cannot move. Shifting of valve 29A to its D-position will put tank 40 in connection with positive chamber 25, while simultaneously the outlet from negative chamber 26 is opened.

The difference between the arrangements according to FIGS. 2 and 3 is thus, that the shock stroke in the former starts without any resistance in negative chamber 26, whereas the shock stroke according to FIG. 3 is initiated by a sudden release of a back pressure in the negative chamber.

The stroke of the ram 1, 2, should be sufficient to permit the desired action without piston 22 actually reaching the outer end cover of cylinder 21. A measuring device 47 is included in conduit 38 to check the outflow from negative chamber 26. This device may be desired to interrupt the flow at a predetermined point, so as to block movement of piston 22, same as receptacle 42 in the arrangement according to FIG. 2.

Figure 4:
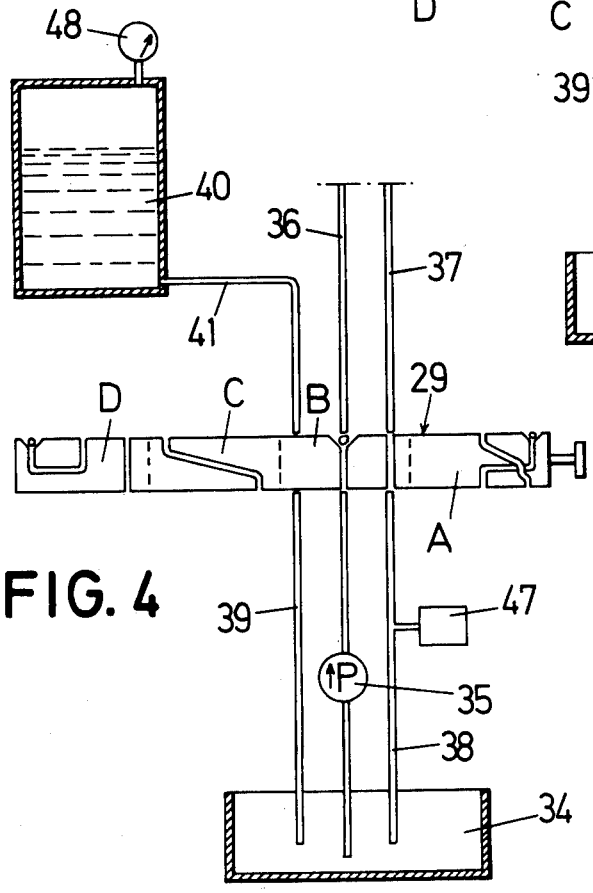

The arrangement according to FIG. 4 acts in a somewhat different manner, but the components are basically the same.

The A and B sections of distributor valve means 29B are the same as before, to make the ram perform the preliminary tensioning. A tank 40 is connected to conduit 41, but will here not deliver fluid to the ram, but rather receive fluid therefrom.

The shock wave is here caused by a release of a final overstrain of the reinforcing member, i.e. ater the desired amount of tensioning has been imparted thereto, piston 22 is made to perform a further power stroke (valve means 29B in its B-position).

When valve 29B is shifted to its C-position tank 40 is put into communication with source 34, by way of conduits 41 and 38 and a certain amount of fluid is permitted to escape. This flow may be measured by a device 47, or the remaining pressure may be directly read at the tank by a manometer 48.

Valve 29B is then shifted to its D-position in which positive chamber 25 is put into communication with tank 40, and the pressure in the chamber is blown off. The movement of piston 22 within cylinder 21 will draw fluid into negative chamber 26 by way of conduits 37, and 38.

By selecting the initial counter pressure in tank 40 and the return flow to chamber 26, the velocity of the retracting reinforcing member 24 may be caused to follow a predetermined pattern.

With very long reinforcing members, or members introduced into tubes 32 of complicated form, it may be advantageous to perform these operations from both ends of the reinforcing members. On occasions it may also be advantageous to perform a shock wave step as an intermediate operation of the basic tensioning, this of course always being terminated by a shock wave operation.

For simplicity's sake FIG. 2 shows a single reinforcing member in tube 32 only, but it is evident that there may be a group of individual, parallel members, as shown in FIG. 1, or that there may be a single wire, or a solid cross section bar filling a mayor part of the passage through the tube.

Fluid receptacle 42 in FIG. 2 may be dispensed with if negative chamber 26 is provided with valve means permitting the entrance of air into said chamber when pump 45 is drawing fluid therefrom. This valve means will, during the following power stroke in the positive chamber allow the air to escape from the negative chamber, but will block any effluent of fluid.

What I claim is:

1. A method of eliminating an uneven stress distribution in an elongated reinforcing member in a concrete structure caused by tensioning said member against a frictional resistance, comprising a. imposing about the desired amount of tensioning upon the member, and b. thereafter suddenly subjecting the member to a measured amount of strain force change.

2. The method according to claim 1 in which the amount of strain force change is an integer multiple of the frictional force to be eliminated.

3. The method according to claim 1 in which the strain force change is adjusted according to measurements performed during the preliminary steps of tensioning.

4. The method according to claim 1 in which the elongation of the member caused by a positive strain force change is limited to a predetermined value.

5. The method according to claim 1 in which the strain force change is applied as a release of an overstraining of the member.

6. The method according to claim 5 in which the speed of movement of the retracting member is varied according to a predetermined pattern.

7. A method of ensuring an even stress distribution in an elongated reinforcing member fitted into a passage in a concrete structure comprising the steps of a. connecting at least one end of said reinforcing member to a pressure fluid operated ram, b. imposing an amount of tensioning upon said member by at least one stroke of said ram, thereby causing an uneven distribution of stresses in said member along the length thereof due to said member being subjected to frictional resistance resulting from the contact between said member and the wall of said passage, and then c. relieving said uneven stress distribution by suddenly connecting said ram to a pressure fluid tank to cause an instantaneous change in the force acting upon said member thereby initiating a shock wave propagating therethrough.

8. The method according to claim 7 further comprising selecting the magnitude of the shock wave force so as to correspond to an integer multiple of the frictional force to be eliminated.

9. The method according to claim 7 further comprising maintaining the pressure within said ram after the last tensioning stroke, and then suddenly connecting the pressure side of the ram to a pressure fluid receiving tank.

10. The method according to claim 7 operable with a ram being a double acting piston unit having a positive chamber for causing the piston to tension the reinforcing member, and a negative chamber for permitting pressure fluid to return the piston after each tensioning stroke, further comprising storing pressure fluid in a tank and after the last tensioning stroke returning the piston of the ram by filling the negative chamber with pressure fluid, connecting said positive chamber to said tank while closing off the negative chamber and then suddenly permitting outflow of fluid from said negative chamber.

11. The method according to claim 10 further comprising connecting a fluid receptacle to said negative chamber, selecting the capacity thereof by permitting a measured volume of fluid to remain in said receptacle corresponding to the difference between the volume of said receptacle and the volume of the effluent from said negative chamber required to bring about an elongation of desired magnitude.

12. The method according to claim 10 further comprising throttling the outflow from said negative chamber according to a predetermined pattern.

13. A method of manufacturing a post-stressed concrete structure, comprising the steps of a. casting the structure and preparing therein at least one passage, for the reception of an elongate reinforcing member, b. connecting at least one end of said reinforcing member to a pressure fluid operated ram, c. imposing an amount of tensioning upon said member by at least one stroke of said ram, thereby causing an uneven distribution of stress in said member along the length thereof due to said tensioning being subjected to frictional resistance resulting from the contact between said member and the wall of said passage, d. relieving said uneven stress distribution by suddenly connecting said ram to a pressure fluid tank to cause an instantaneous change in the force acting upon said member thereby initiating a shock wave propagating therethrough, e. filling the channel around said strengthening member with a cement slurry, and f. permitting said slurry to settle and finally releasing the external tensioning force on the member.

* * * * *